US007028503B2

(12) United States Patent
Lyvers et al.

(10) Patent No.: US 7,028,503 B2
(45) Date of Patent: Apr. 18, 2006

(54) REFRIGERATOR MODULAR STORAGE ASSEMBLIES

(75) Inventors: Daniel Lyvers, Cordova, TN (US); Alan Clark Webb, Cordova, TN (US); John Sylvester, Haughton, LA (US); Raymond M. Nilssen, Greenwood, MS (US)

(73) Assignee: Viking Range Corporation, Greenwood, MS (US)

( * ) Notice: Subject to any disclaimer, the term of this patent is extended or adjusted under 35 U.S.C. 154(b) by 0 days.

(21) Appl. No.: 10/896,677

(22) Filed: Jul. 22, 2004

(65) Prior Publication Data

US 2006/0016211 A1 Jan. 26, 2006

(51) Int. Cl.
*F25C 5/18* (2006.01)

(52) U.S. Cl. ..... 62/344; 62/441; 312/404; 312/334.7

(58) Field of Classification Search ..... 62/344, 62/382, 440, 441; 312/404, 408, 330.1, 334.7, 312/334.8

See application file for complete search history.

(56) References Cited

U.S. PATENT DOCUMENTS

| | | | | |
|---|---|---|---|---|
| 2,443,787 | A * | 6/1948 | Earle | 62/258 |
| 2,893,805 | A * | 7/1959 | Ferguson | 312/402 |
| 2,984,533 | A * | 5/1961 | Sundberg | 312/408 |
| 3,744,270 | A * | 7/1973 | Wilcox | 62/344 |
| 4,303,286 | A * | 12/1981 | McClellan | 312/409 |
| 4,557,118 | A * | 12/1985 | Pink et al. | 62/382 |
| 4,751,826 | A * | 6/1988 | Kawahara et al. | 62/382 |
| 4,870,836 | A * | 10/1989 | Pink | 62/382 |
| 6,880,902 | B1 * | 4/2005 | Zimmerman | 312/404 |

* cited by examiner

*Primary Examiner*—William E. Tapolcai
(74) *Attorney, Agent, or Firm*—Womble Carlyle Sandridge & Rice, PLLC

(57) ABSTRACT

Modular storage assemblies for refrigerators are provided. The storage assemblies include drawers formed of multi-component frames that support pans. The drawers are provided in a variety of configurations and include parts that can be used in various configurations.

43 Claims, 10 Drawing Sheets

REFRIGERATOR MODULAR STORAGE ASSEMBLIES

TECHNICAL FIELD

The disclosure relates generally to refrigerators and, more particularly, to storage assemblies for refrigerator cabinets.

BACKGROUND

Over the years, household refrigerators have evolved to accommodate ever increasing functional demands by users. In addition to preserving food, refrigerators must be functionally versatile, easy to maintain and reasonably priced. Consumers desire refrigerators with adjustable storage compartments that can accommodate a variety of food and that are easily accessible to facilitate cleaning and maintenance. As a result, various manufacturers have offered refrigerators with movable shelves and storage assemblies.

Presently, refrigerators usually include various sized storage assemblies that are formed of injection molded polymeric components. In order to produce these various-sized storage assemblies, however, a manufacturer must construct a separate mold for each size of component. These molds can be expensive, add to the cost of the final product and lengthen the time needed to bring a new product to market.

SUMMARY

Briefly described, the present invention includes refrigerators and refrigerator storage assemblies having modular drawer components. Multi-component drawers forming the storage assemblies employ parts that can be used in multiple conformations, thereby potentially reducing the cost and time of manufacturing different storage assemblies with different configurations.

In one aspect of the present invention, a refrigerator has a cooling compartment formed of a top wall, a bottom wall, a rear wall, a first side wall, and a second side wall opposed to the first side wall. A storage assembly is disposed in the cooling compartment. The storage assembly includes at least one mounting bracket mounted on one of the first and the second side walls and at least one drawer movably connected to the bracket. The drawer comprises a multi-component frame and at least one bin detachably supported by the multi-component frame.

In another aspect of the present invention, a refrigerator is provided which includes a cabinet having an insulated compartment disposed therein and a storage assembly disposed in the insulated compartment. The storage assembly comprises at least one drawer movably mounted in the insulated compartment. The drawer includes a frame supporting at least one bin, with the frame having a front bracket attached to a pair of side brackets, wherein each of the side brackets is attached to a rear bracket.

In a further aspect of the present invention, the disclosure includes a storage assembly for a refrigerator comprising at least one pair of mounting brackets and at least one drawer movably connected to each of the pair of mounting brackets. The drawer comprises a multi-component frame, at least one bin detachably supported by the multi-component frame, and a fascia attached to the multi-component frame.

These and other aspects of the disclosure are set forth in greater detail in the detailed description below and the drawings, which are briefly described as follows.

DETAILED DESCRIPTION

Figure 1:
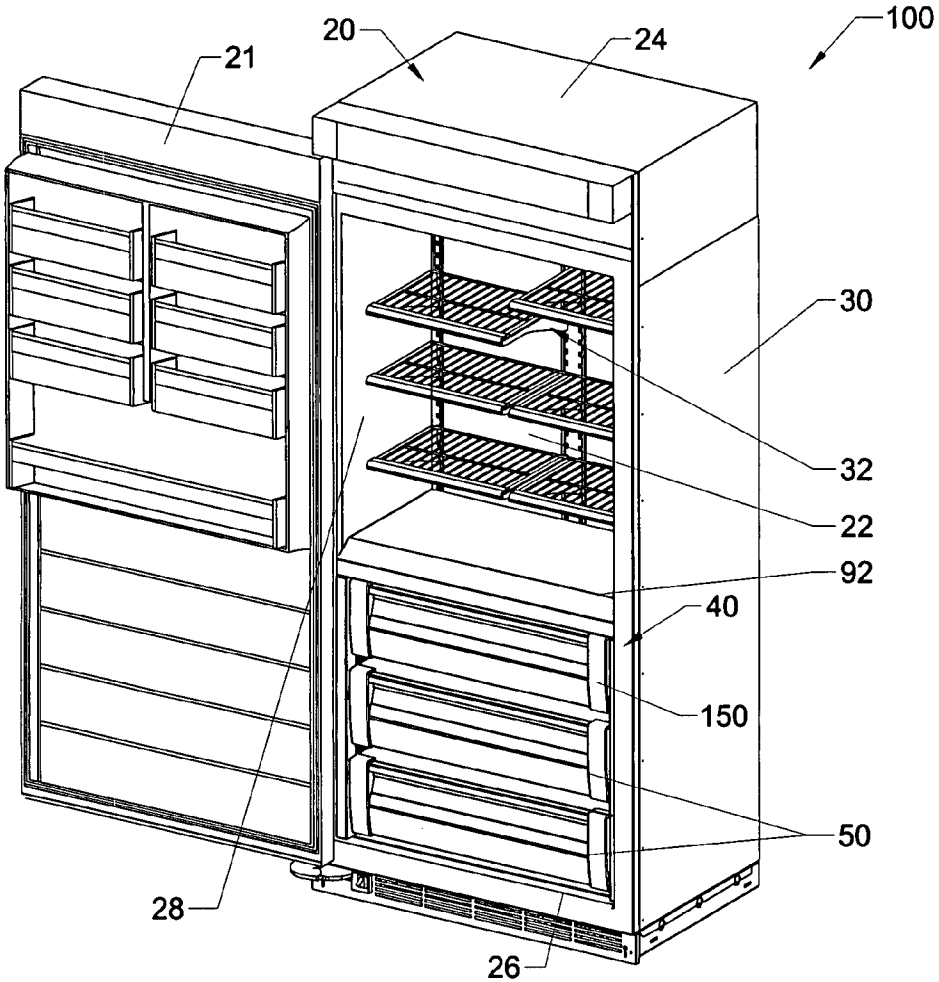
FIG. 1 is a perspective view of refrigerator containing a modular storage assembly.

Referring now in more detail to FIGS. 1–10, in which like numerals refer where appropriate to like parts throughout the several views, FIG. 1 depicts a refrigerator 100 that contains a modular storage assembly 40. The refrigerator 100 includes a cabinet 20 to which is attached a door 21. The cabinet 20 includes a top wall 24, a rear wall 22, a bottom wall 26, and first and second side walls 28 and 30. The walls of the cabinet 20 cooperate to define an insulated cooling compartment 32, which can be used for refrigerating and/or freezing food. The modular storage assembly 40 includes one or more drawers 50 and 150 that are movably mounted in the cooling compartment 32. The drawers of the storage assemblies disclosed herein are themselves multi-component assemblies. At least some of the parts used to fabricate the drawers of the storage assemblies are designed to be interchangeably used on drawers of varying size, thereby potentially reducing the tooling and manufacturing costs in making variously configured storage assemblies for different refrigerator models.

Figure 2:
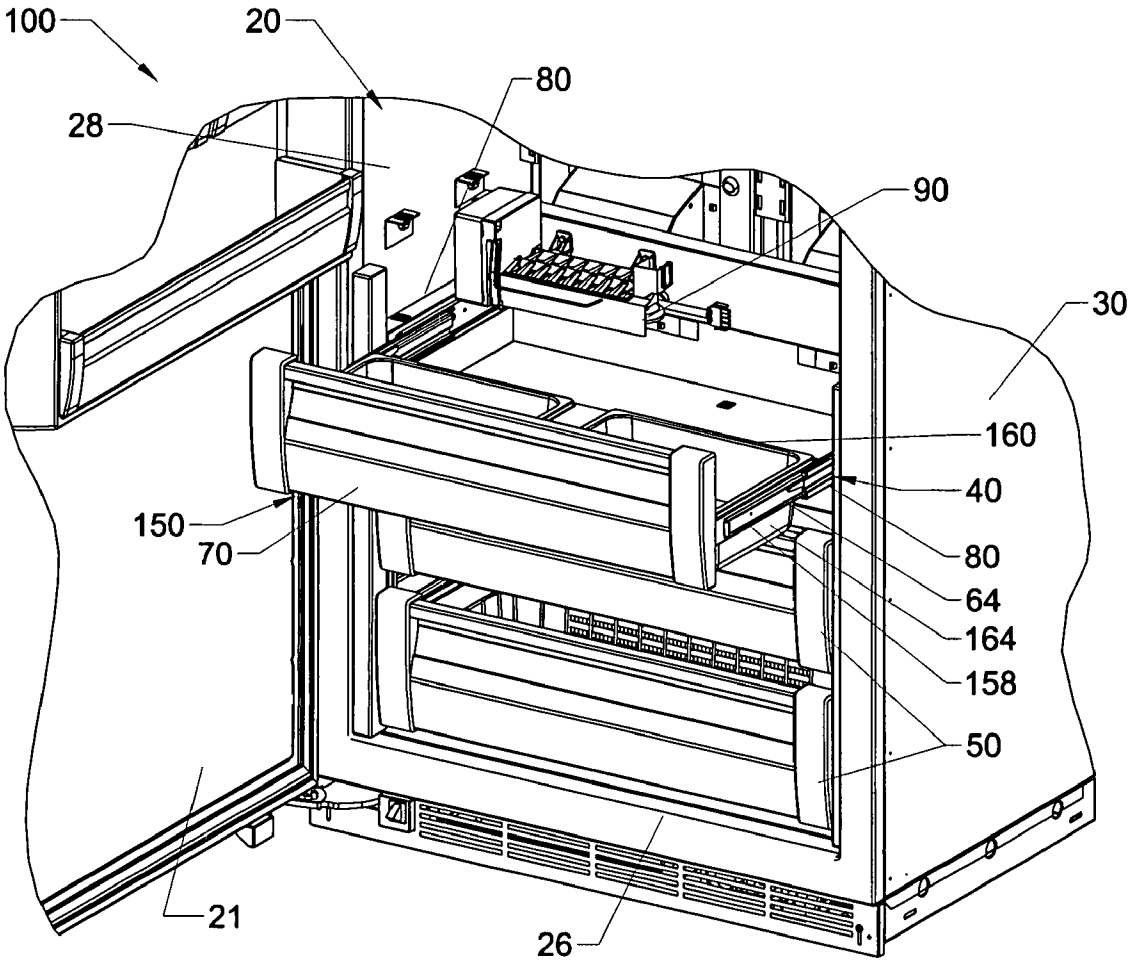
FIG. 2 is a perspective view of the refrigerator of FIG. 1 with the top drawer open and the ice shelf assembly removed to show the ice maker.
Figure 7:
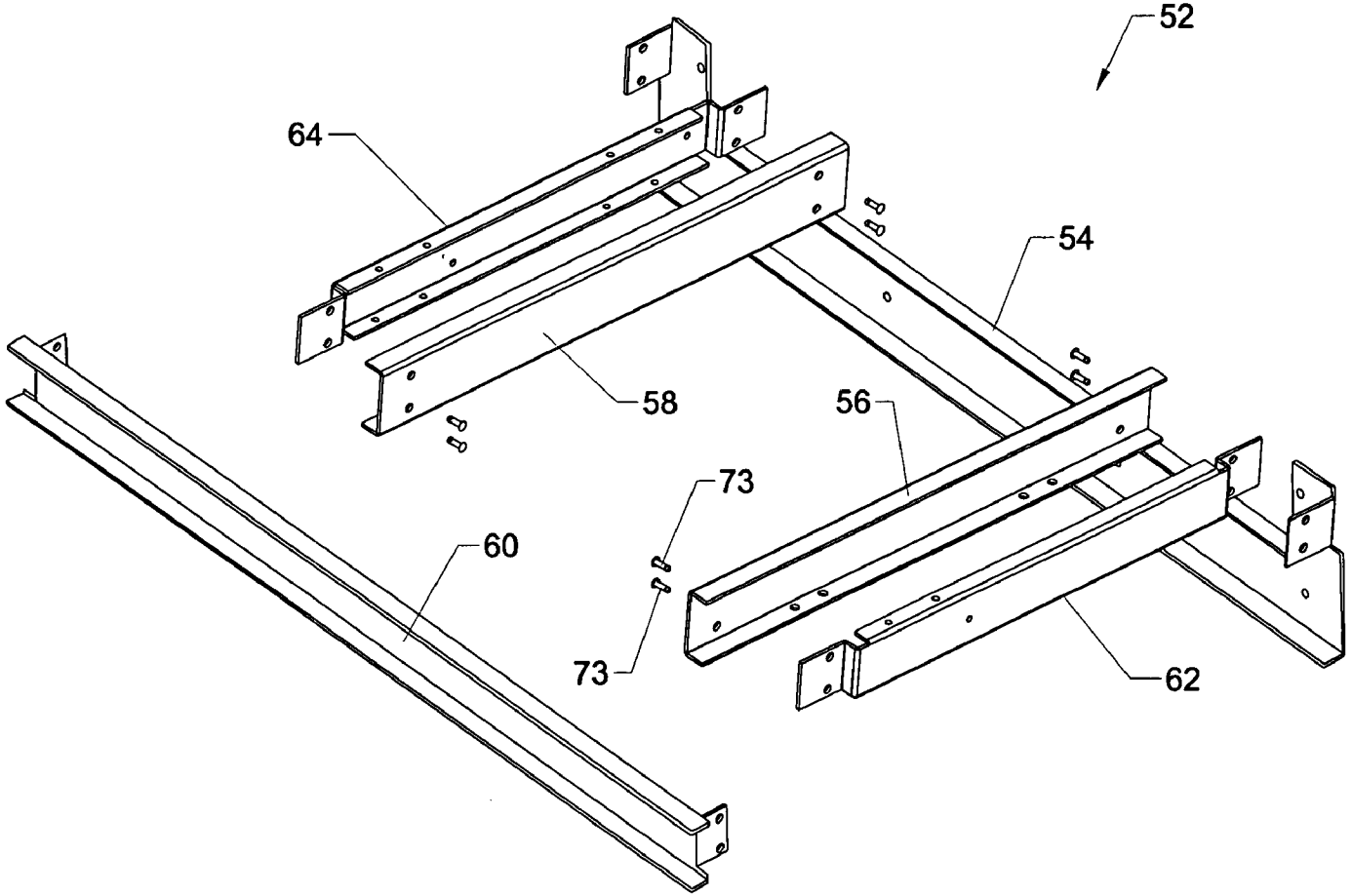
FIG. 7 is an exploded view of the frame of the drawer shown in FIG. 6.

As shown in FIGS. 2 and 7, the drawers 50 and 150 slide in and out of the cooling compartment 32 on first and second glide mount brackets 62 and 64 that cooperate with the mounting brackets 80 on the side walls 28 and 30 of the cabinet 20. With the removal of the ice cover assembly 92 (FIG. 1), ice maker 90 is shown as being disposed above one of the drawers 150 to allow ice cubes formed in the ice maker 90 to be collected in the drawer 150 below.

Figure 4:
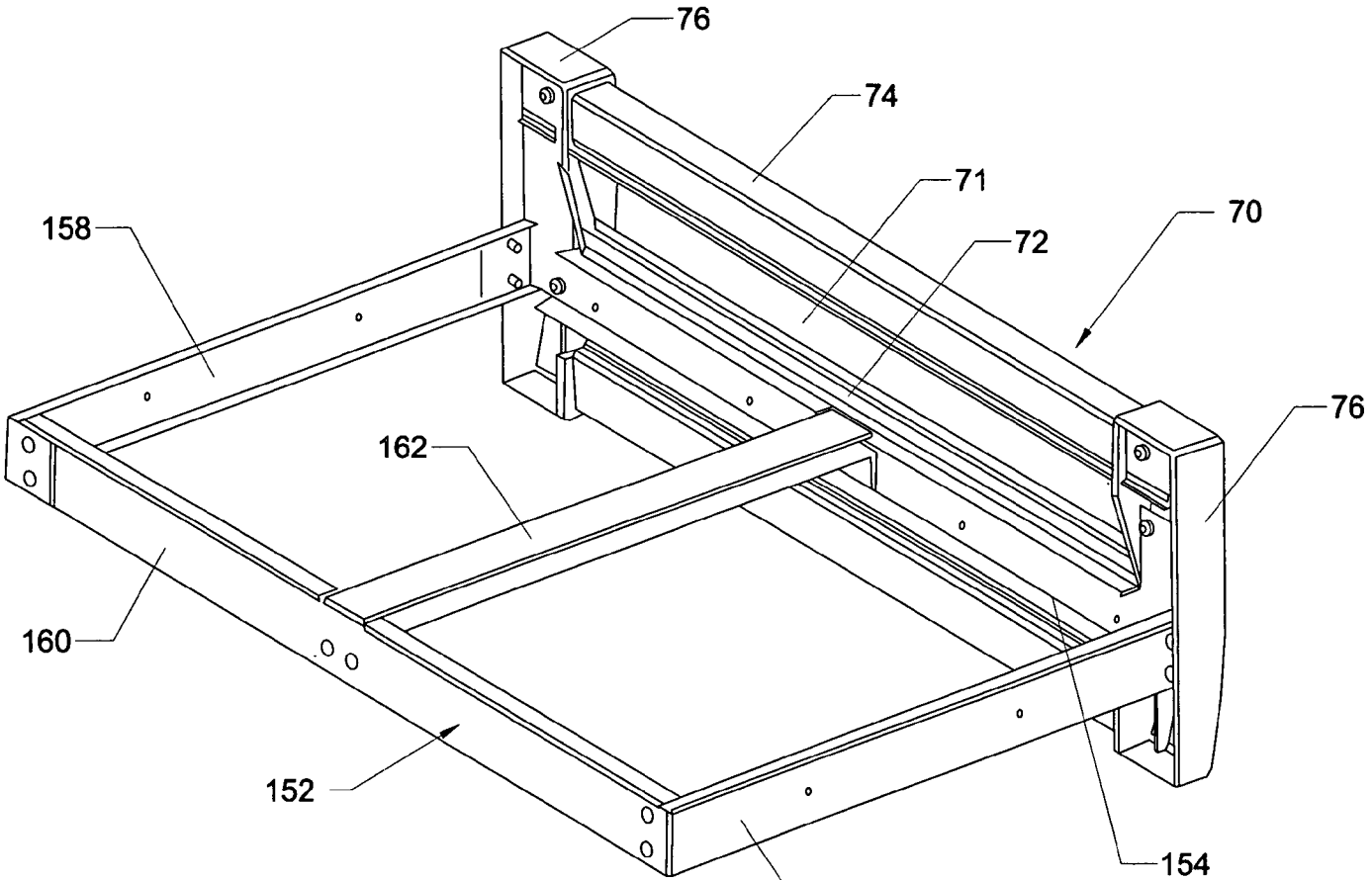
FIG. 4 is a perspective view of the frame and fascia of the drawer shown in FIG. 3.
Figure 5:
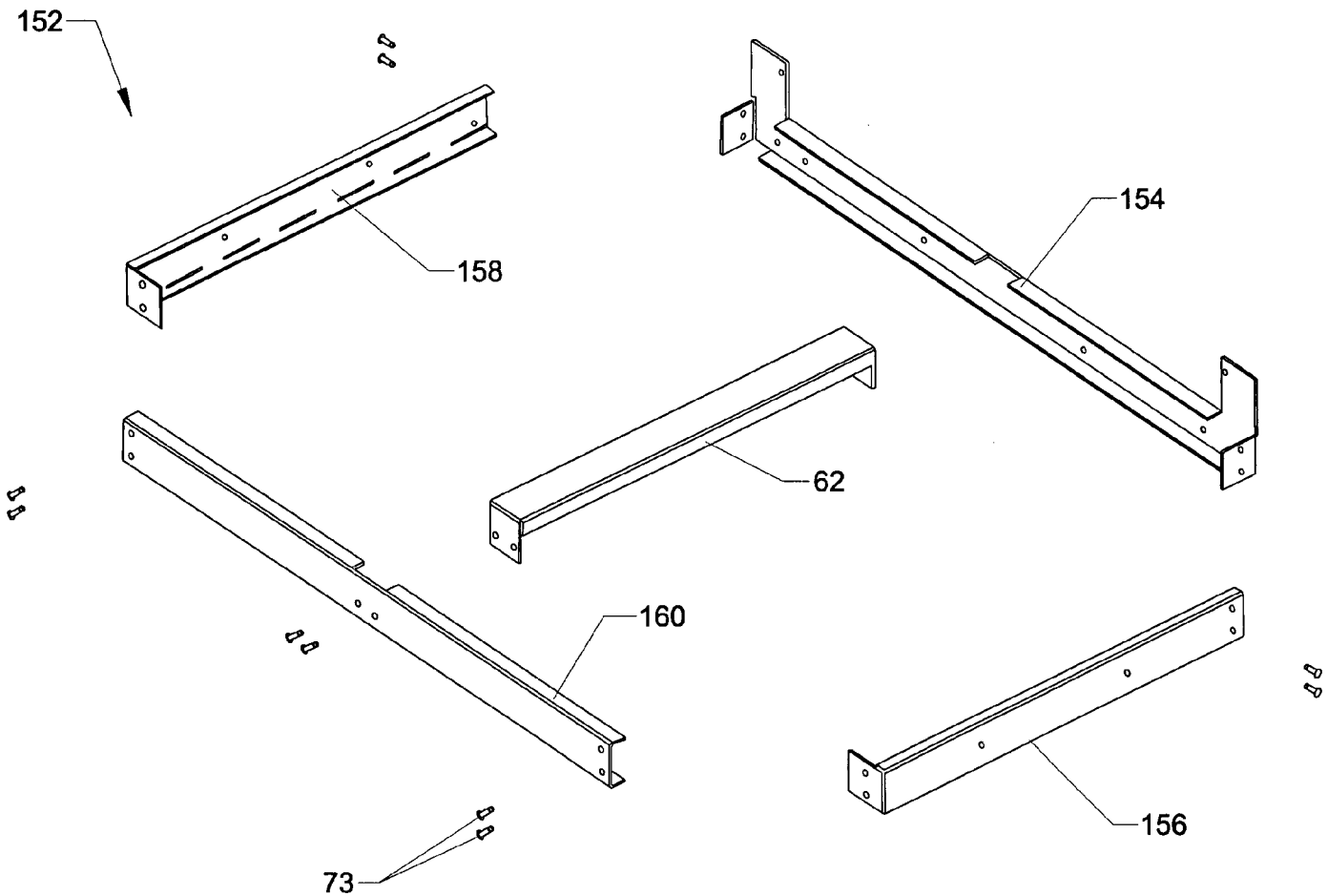
FIG. 5 is an exploded view of the frame of the drawer shown in FIG. 3.
Figure 6:
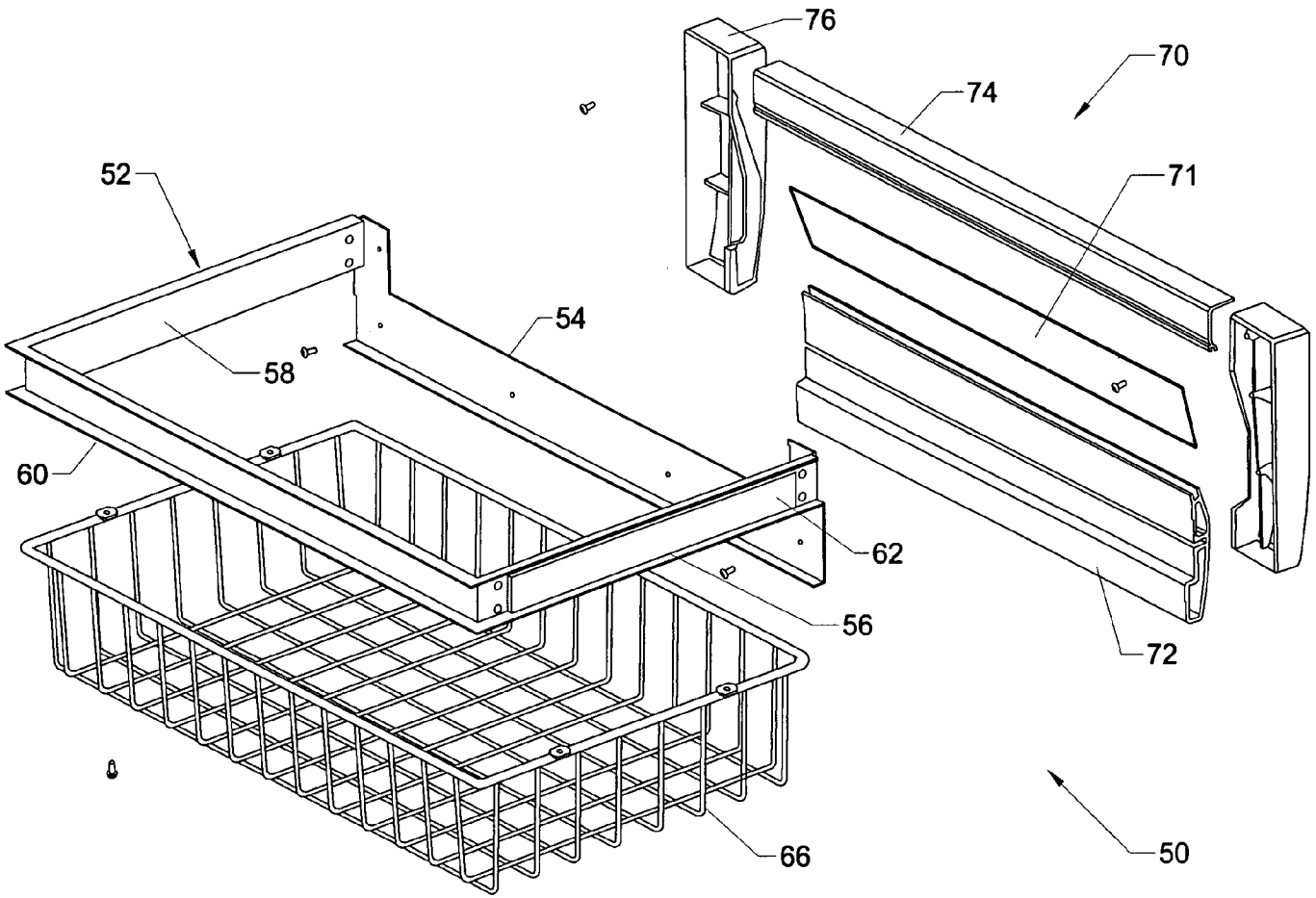
FIG. 6 is an exploded view of the bottom drawer of the storage assembly of the refrigerator shown in FIG. 1.

Referring to FIGS. 2–5, the drawer 150 is a solid bottom drawer, as opposed to the basket type drawers 50 shown in FIG. 6. The solid bottoms of drawer 150 are formed by pans 164 supported by a frame 152. Generally, one or more of the drawers of the storage assemblies includes one or more bins supported by a frame. In the case of drawer 150, the two pans 164 constitute the bins of the drawer and are detachably supported by the frame 152. When installed on the frame 152, the pans 164 are within close proximity to each other. The pans 164 are positioned in the openings formed in the frame 152 so that their top flanges rest on and are supported by the frame 152. In this way, the pans 164 can be removed easily from the drawer 150 and the refrigerator 100, which can be useful when the pans are used to collect ice produced by ice maker 90.

Figure 3:
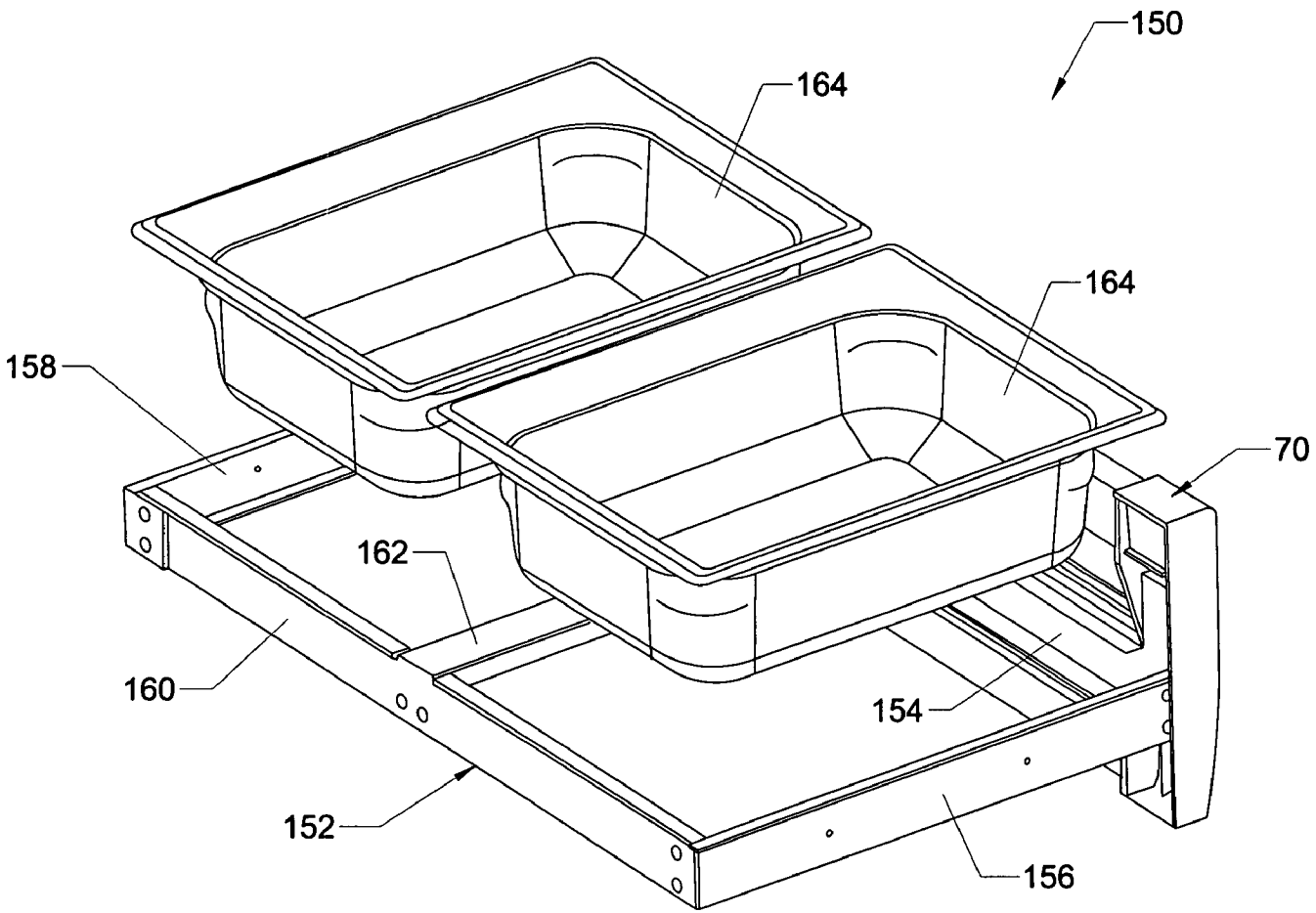
FIG. 3 is a perspective view of the top drawer of the storage assembly shown in FIG. 2 removed and the pans separated from the frame of the drawer.

The frame 152 of the drawer 150, shown in FIGS. 3–5, includes a front bracket 154 having opposed ends to which are attached pair of side brackets, first and second side brackets 156 and 158. A rear bracket 160 is aligned parallel to the front bracket 154 and has opposed ends that are attached to the rear ends of the first and second side brackets 156 and 158. An intermediate bracket 162 is connected to both the front and rear brackets 154 and 160. The brackets of the frame 152 are shown attached to each other by fasteners 73, which can be screws, pins, clips or similar fasteners. A fascia 70 is attached to the front portion of the frame 152, such as by fasteners disposed through front bracket 154.

FIGS. 6 and 7 show a drawer 50, which, instead of two pans, includes a wire basket 66 constituting the bin portion of the drawer. Like drawer 150, drawer 50 includes a multi-component frame 52 supporting the basket 66. As shown in FIG. 6, a wire basket 66 is attached to the frame 52 by fasteners 73, which are shown as screws that are threaded through holes formed in both the wire basket 66 and the frame 52. The frame 52 includes a front bracket 54, first and second side brackets 56 and 58 attached to the opposed ends of the front bracket, and a rear bracket 60 attached to the first and second side brackets. The brackets are shown as being connected to each other by fasteners 73. First and second glide mount brackets 62 and 64 are attached to the first and second side brackets 56 and 58, respectively. The glide mount brackets 62 and 64 cooperate with the mounting brackets 80 mounted in the refrigerator 100 to allow the drawers of a storage assembly to slide easily in and out of the cabinet 20.

The frames 52 and 152 of the drawers 50 and 150 of the storage assembly 40 can be made of a metal, such as aluminum or galvanized steel, or a polymeric material, such as an acrylonitrile-butadiene-styrene terpolymer (ABS). Although the frame brackets can be molded, they also can be extruded, stamped, rolled or similarly formed in order to reduce tooling costs when compared with making separate molds for each size and variation of drawer.

Drawer 50 also includes a fascia 70 attached to the front bracket 54 of frame 52. The fascia 70 generally includes a face plate 72 having opposed ends to which are attached end caps 76. A second plate 71 is disposed in a channel formed in the face plate 72 and a top cap 74 is disposed over the second plate 71 and connected to the end caps 76. The second plate 71 can be translucent in certain configurations. The face plate 72 and top cap 74 can be formed of metal, such as aluminum or galvanized steel, or a polymeric material, such as an ABS co-polymer. As shown in FIG. 6, the face plate 72 and the top cap 74 are extrusions. The end caps 76 also can be formed of metal or polymeric material. The end caps 76, shown in FIG. 6 are molded polymeric components. The second plate 71 can be formed of glass or a polymeric material that too can be extruded.

The bins used to form the drawers of the disclosed storage assemblies can be solid pans, baskets or plates (not shown). The bins can be detachably supported by the frames in that they either rest on the frames, as in the case of the pans 164 and frame 152, or are attached to the frame by one or more of an appropriate fastener, as in the case of the baskets 66. In addition to being detachably supported by the frame, the bins can be more permanently secured to the frame by welding or similar means. In any case, the drawers of the storage assemblies generally are not constructed such that the frames and the bins are unitary. Rather, the frames and bins generally are constructed of separate pieces that may be attached to each other to form the drawers of the storage assemblies.

Figure 8:
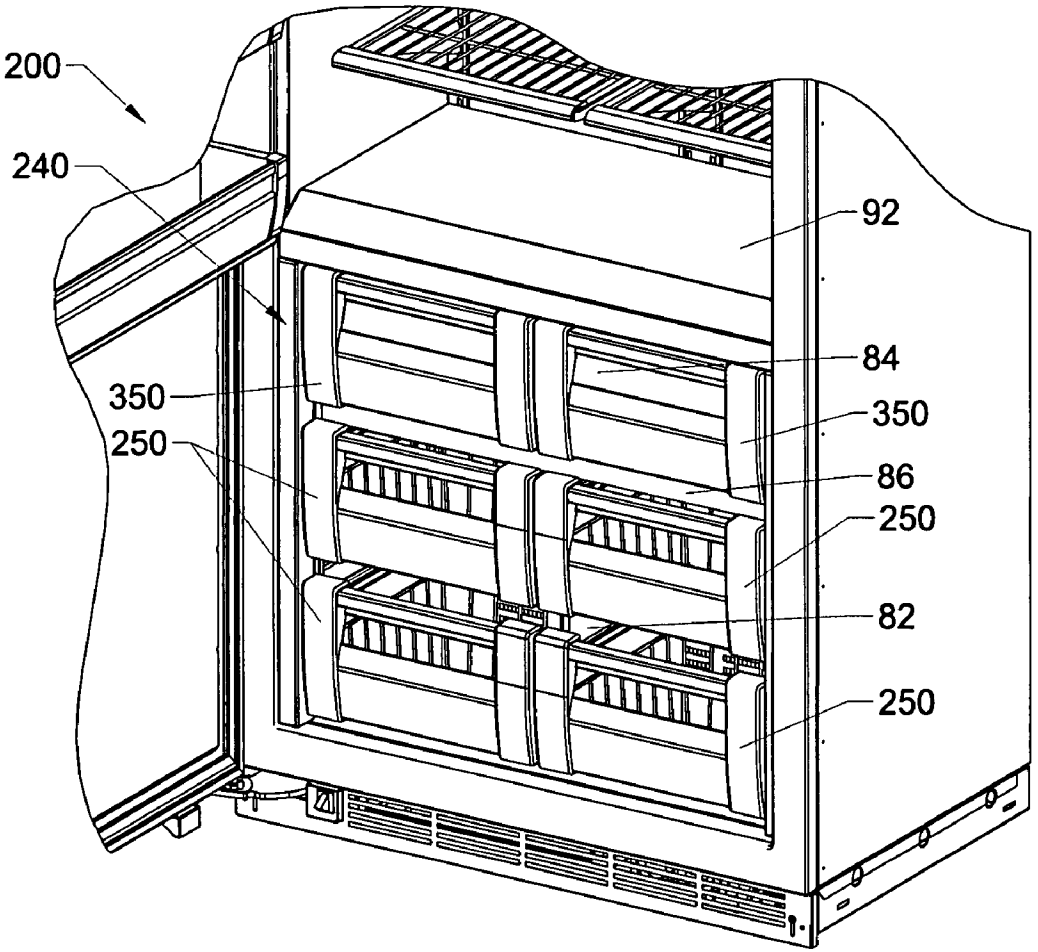
FIG. 8 is a perspective view of another refrigerator containing a storage assembly.
Figure 9:
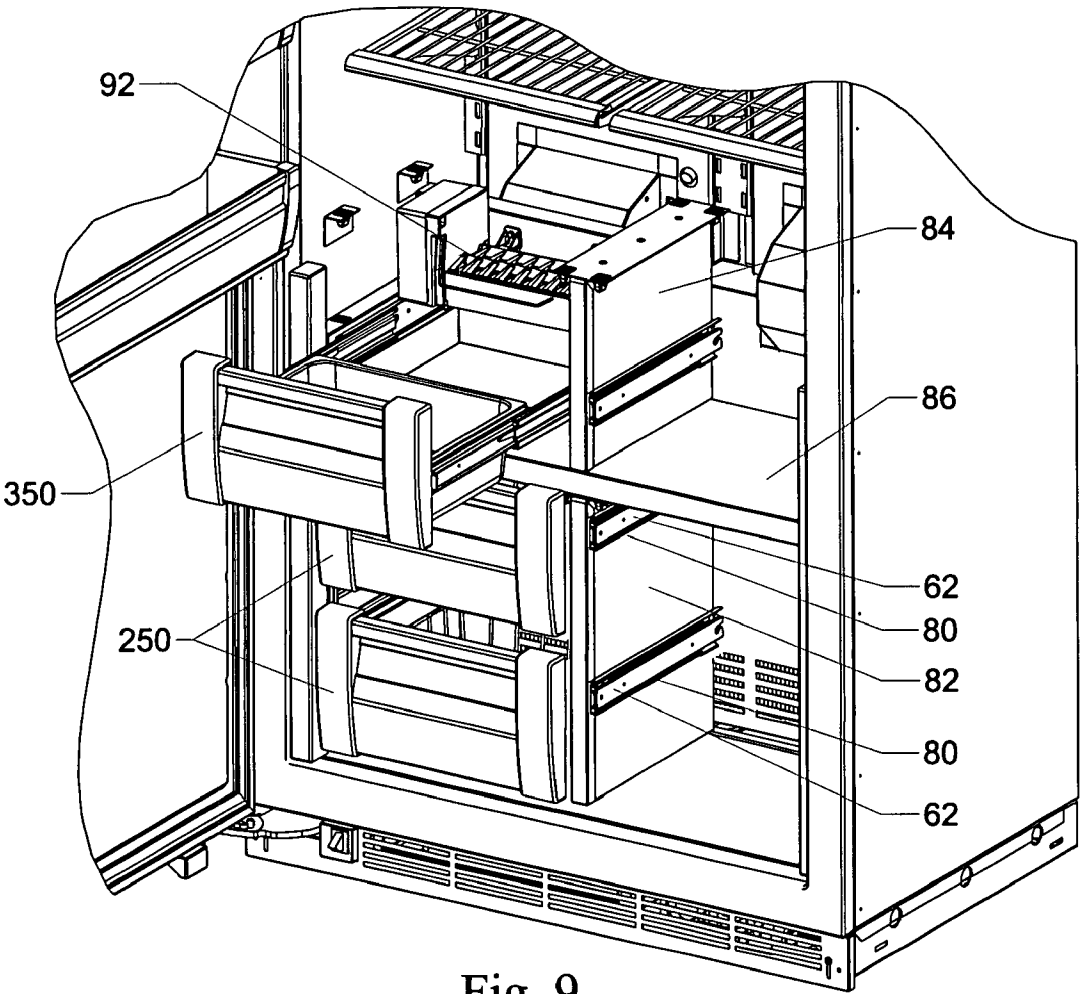
FIG. 9 is a perspective view of the refrigerator of FIG. 8 with the right-side drawers of the storage assembly and the ice cover assembly removed.
Figure 10:
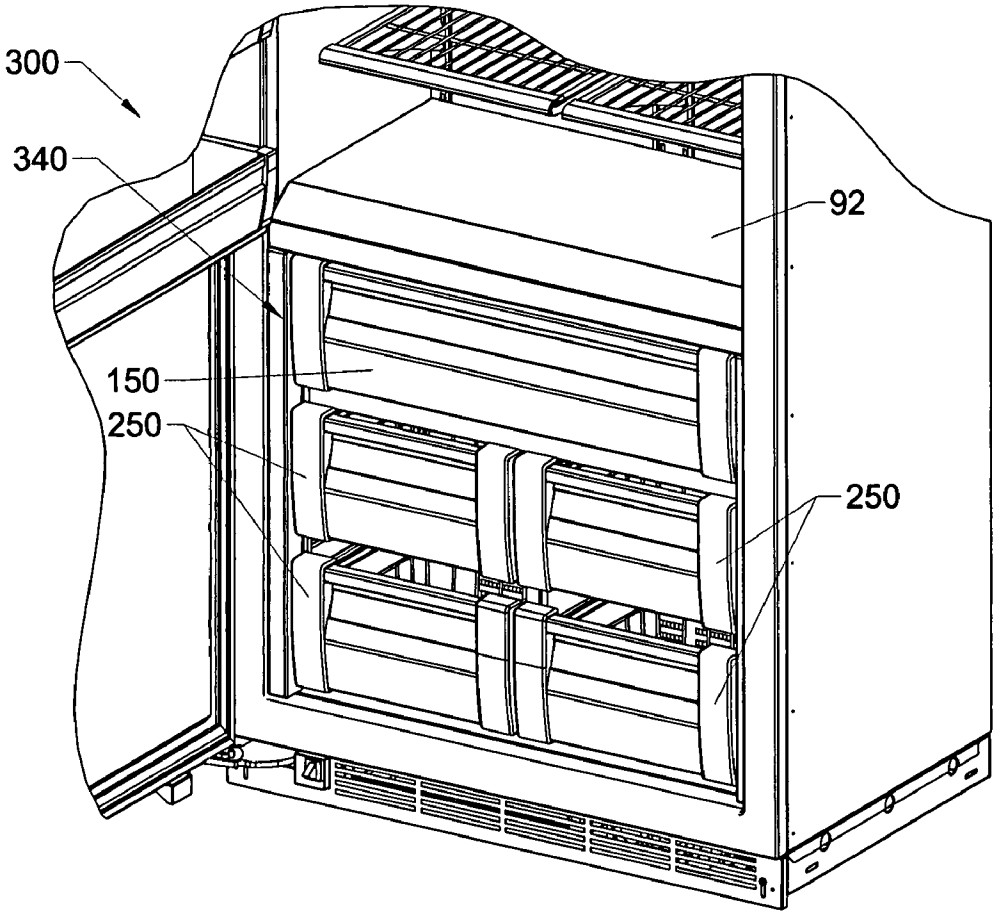
FIG. 10 is a perspective view of yet another refrigerator containing a storage assembly.

The refrigerators 200 and 300 shown in FIGS. 8–10 contain storage assemblies 240 and 340 with alternative combinations of pluralities of drawers 150, 250, and 350. For drawers 250 and 350, which do not extend across the entire width of the refrigeration cabinet, mullions 84 and 86 can be used to provide support for both the mounting brackets 80 and drawers 250 and 350 slidably attached thereto. As shown in FIG. 9, a mullion shelf 86 also can be used in combination with the upper and lower mullions 84 and 86 to provide support for the drawers of the storage assembly 240. The mullions can be attached to the walls of the cabinet by brackets.

Due to the use of multiple components in forming the drawers of the disclosed storage assemblies, the storage assemblies can be produced with variations in size, finish, and design that do not necessitate providing completely different molds or tools for each variation. For example, drawers can be provided in the storage assembly that are more narrow than those shown in FIGS. 1 and 2. For instance, the drawers 250 and 350, shown in FIGS. 8–10, can be narrower than the drawers 50 and 150. The drawers 250, 350 can include many of the same components as those used to form the drawers 50 and 150. By simply shortening the lengths of the extrusions used to form the face plates, the top caps, and the front and rear brackets, and selecting smaller baskets or a single pan, the remaining components of the drawers 250 and 350 can be substantially the same as those used to form the drawers 50 and 150.

It is to be understood that the above examples of storage assemblies are provided for illustration and are not to be construed to limit the scope of the disclosure. The disclosure encompasses modifications and alterations made by those of ordinary skill in the art to the disclosed examples.

What is claimed is:

1. A refrigerator comprising:

a cooling compartment comprising a top wall a bottom wall, a rear wall, a first side wall and a second side wall opposed to the first side wall;

a storage assembly disposed in the cooling compartment, wherein the storage assembly comprises at least one mounting bracket mounted on one of the first and the second side walls and at least one drawer movably connected to the bracket, wherein the drawer comprises a multi-component frame and at least one bin detachably supported by the multi-component frame;

wherein the multi-component frame comprises a front bracket having opposed ends each of which is attached to one of a pair of opposed side brackets, and wherein the pair of opposed side brackets is attached to a rear bracket;

wherein the multi-component frame further comprises an intermediate bracket connected to the front bracket and the rear bracket.

2. The refrigerator of claim 1, wherein the bin comprises a wire basket.

3. The refrigerator of claim 1, wherein the bin comprises a pan.

4. The refrigerator of claim 1, wherein the bin comprises more than one pan.

5. The refrigerator of claim 1, wherein the multi-component frame further comprises a pair of glide mount brackets, wherein each one of the pair of glide mount brackets is attached to one of the pair of opposed side brackets.

6. The refrigerator of claim 5, wherein each of the glide mount brackets is movably connected to one of the at least one mounting bracket.

7. The refrigerator of claim 1, wherein the multi-component frame comprises metal brackets.

8. The refrigerator of claim 1, wherein the front, side, and rear brackets are formed of metal.

9. The refrigerator of claim 1, wherein the drawer comprises at least two pans detachably supported by the multi-component frame.

10. The refrigerator of claim 1, wherein the at least one drawer is one of a plurality of drawers movably mounted in the cooling compartment.

11. The refrigerator of claim 10, wherein at least one of the plurality of drawers comprises a wire basket and at least one of another of the plurality of drawers comprises a pan.

12. The refrigerator of claim 10, wherein at least one of the plurality of drawers comprises more than one basket and at least one of another of the plurality of drawers comprises more than one pan.

13. The refrigerator of claim 1, further comprising an ice maker disposed in the cooling compartment and aligned above the drawer.

14. The refrigerator of claim 1, wherein the storage assembly comprises a mullion attached to at least one of the top, bottom rear, and side walls.

15. A refrigerator comprising:

a cooling compartment comprising a top wall a bottom wall, a rear wall, a first side wall and a second side wall opposed to the first side wall;

a storage assembly disposed in the cooling compartment, wherein the storage assembly comprises at least one mounting bracket mounted on one of the first and the second side walls and at least one drawer movably connected to the bracket, wherein the drawer comprises a multi-component frame and at least one bin detachably supported by the multi-component frame;

wherein the drawer includes a fascia; the fascia comprising a face plate having opposed ends each with an attached end cap; the fascia being attached to the multi-component frame.

16. The refrigerator of claim 15, wherein the face plate comprises an extrusion.

17. A refrigerator comprising:

a cooling compartment comprising a top wall a bottom wall, a rear wall, a first side wall and a second side wall opposed to the first side wall;

a storage assembly disposed in the cooling compartment, wherein the storage assembly comprises at least one mounting bracket mounted on one of the first and the second side walls and at least one drawer movably connected to the bracket wherein the drawer comprises a multi-component frame and at least one bin detachably supported by the multi-component frame;

wherein the storage assembly comprises a mullion attached to at least one of the top, bottom rear, and side walls;

wherein a mounting bracket is mounted on the mullion.

18. A refrigerator comprising:

a cabinet having an insulated compartment disposed therein;

a storage assembly disposed in the insulated compartment, wherein the storage assembly comprises at least one drawer movably mounted in the insulated compartment, the drawer comprising a frame supporting at least one bin, wherein the frame comprises a front bracket attached to a pair of side brackets, and a rear bracket attached to the pair of side brackets;

wherein the frame comprises an intermediate bracket connected to the front bracket and the rear bracket.

19. The refrigerator of claim 18, wherein the bin comprises a wire basket.

20. The refrigerator of claim 18, wherein the bin comprises more than one basket.

21. The refrigerator of claim 18, wherein the bin comprises a pan.

22. The refrigerator of claim 18, wherein the bin comprises more than one pan.

23. The refrigerator of claim 18, wherein the at least one bin comprises at least two pans supported by the frame.

24. The refrigerator of claim 18, wherein the front, rear and pair of side brackets are formed of metal.

25. The refrigerator of claim 18, further comprising an ice maker disposed in the cooling compartment above the drawer.

26. The refrigerator of claim 18, further comprising a pair of mounting brackets disposed in the cabinet, wherein the drawer is movably connected to the pair of mounting brackets.

27. The refrigerator of claim 18, wherein the storage assembly further comprises a mullion disposed in the cabinet, wherein the drawer is movably mounted to the mullion.

28. The refrigerator of claim 18, wherein the cabinet comprises a pair of opposed side walls, and wherein the drawer is movably mounted to the pair of opposed side walls.

29. The refrigerator of claim 18, wherein the frame further comprises a pair of glide mount brackets, wherein each of the pair of glide mount brackets is attached to one of the pair of side brackets.

30. A refrigerator comprising:

a cabinet having an insulated compartment disposed therein;

a storage assembly disposed in the insulated compartment, wherein the storage assembly comprises at least one drawer movably mounted in the insulated compartment, the drawer comprising a frame supporting at least one bin, wherein the frame comprises a front bracket attached to a pair of side brackets, and a rear bracket attached to the pair of side brackets;

wherein the frame comprises an intermediate bracket connected to the front bracket and the rear bracket;

wherein the drawer further comprises a fascia; the fascia comprising a face plate having opposed ends each with an attached end cap; the fascia being attached to the fame.

31. The refrigerator of claim 30, wherein the face plate comprises an extrusion.

32. A storage assembly for a refrigerator comprising:

at least one pair of mounting brackets;

at least one drawer movably connected to each of the pair of mounting brackets, wherein the drawer comprises a multi-component frame, at least one bin detachably supported by the multi-component frame, and a fascia attached to the multi-component frame;

wherein the fascia comprises a face plate having opposed ends each with an attached end cap.

33. The storage assembly of claim 32, wherein the frame comprises a front bracket attached to a pair of side brackets, and a rear bracket attached to the pair of side brackets.

34. The storage assembly of claim 32, wherein the bin comprises a pan.

35. The storage assembly of claim 32, wherein the bin comprises more than one pan.

36. The storage assembly of claim 32, wherein the bin comprises a wire basket.

37. The storage assembly of claim 32, wherein the face plate is an extrusion.

38. The storage assembly of claim 32, wherein the multi-component frame is formed of metal.

39. The storage assembly of claim 32, wherein the multi-component frame further comprises a pair of glide mount brackets movably connected to the pair of mounting brackets.

40. The storage assembly of claim 32, wherein the pair of mounting brackets is one of a plurality of mounting brackets and the drawer is one of a plurality of drawers, wherein each of the plurality of drawers is movably connected to one of the plurality of pairs of mounting brackets, and wherein the plurality of drawers are mounted in close proximity to each other within a refrigerator.

41. The storage assembly of claim 40, wherein the plurality of drawers comprises at least one drawer comprising a wire basket and at least one drawer comprising a pan.

42. The storage assembly of claim 40, wherein the plurality of drawers comprises at least one drawer comprising more than one basket and at least one drawer comprising more than one pan.

43. The storage assembly of claim 32, wherein the multi-component frame comprises an intermediate bracket attached to a front and a rear bracket, and wherein the drawer comprises at least two pans.

* * * * *